United States Patent [19]

Packham

[11] Patent Number: 4,575,941

[45] Date of Patent: Mar. 18, 1986

[54] DRY SHAVERS

[75] Inventor: Charles C. Packham, Wokingham, United Kingdom

[73] Assignee: The Gillette Company, Boston, Mass.

[21] Appl. No.: 691,365

[22] Filed: Jan. 14, 1985

Related U.S. Application Data

[63] Continuation of Ser. No. 443,974, Nov. 23, 1982, abandoned.

[30] Foreign Application Priority Data

Nov. 23, 1981 [GB] United Kingdom ..... 8135234
Nov. 23, 1981 [GB] United Kingdom ..... 8225907

[51] Int. Cl.[4] ..... B26B 19/04

[52] U.S. Cl. ..... 30/346.51; 30/43; 30/43.91

[58] Field of Search ..... 30/43, 43.91, 43.92, 30/346.51

[56] References Cited

U.S. PATENT DOCUMENTS

| | | | |
|---|---|---|---|
| Re. 21,192 | 8/1939 | Stein | 30/43 |
| 2,146,783 | 2/1939 | Whalen . | |
| 2,168,406 | 8/1939 | Harris . | |
| 2,253,737 | 8/1941 | Testi . | |
| 2,307,471 | 1/1943 | Schaffer et al. | 30/346.51 X |
| 2,325,267 | 7/1943 | Murphy . | |
| 2,332,379 | 10/1943 | Harris | 30/346.51 X |
| 2,787,829 | 4/1957 | Bayle . | |
| 2,833,033 | 5/1958 | Heyek | 30/346.51 |
| 2,900,719 | 8/1959 | Kohner et al. . | |
| 3,045,345 | 7/1962 | Bermingham . | |
| 3,060,569 | 10/1962 | Oliver et al. . | |
| 3,196,541 | 7/1965 | Foley et al. | 30/43.92 |
| 3,643,330 | 2/1972 | Brown | 30/346.51 |
| 4,170,822 | 10/1979 | Groothius et al. | 30/346.51 X |

FOREIGN PATENT DOCUMENTS

| | | |
|---|---|---|
| 171778 | 7/1952 | Austria . |
| 573007 | 3/1933 | Fed. Rep. of Germany . |
| 1004519 | 8/1957 | Fed. Rep. of Germany . |
| 1177035 | 8/1964 | Fed. Rep. of Germany . |
| 1227811 | 4/1960 | France . |
| 175497 | 8/1912 | Japan . |
| 177782 | 8/1931 | Japan . |

*Primary Examiner*—E. R. Kazenske
*Assistant Examiner*—Willmon Fridie, Jr.
*Attorney, Agent, or Firm*—Scott R. Foster; Raymond J. De Vellis

[57] ABSTRACT

An inner cutter for a dry shaver is formed from a tube of hardenable steel which is slotted transversely to form a series of bridge members on which individual teeth are formed by shallow annular grooves which locally reduce the thickness of the bridge members.

6 Claims, 6 Drawing Figures

DRY SHAVERS

This application is a continuation, of application Ser. No. 443,974, filed Nov. 23, 1982 now abandoned.

This invention relates to dry shavers of the type comprising an arched perforated foil forming a shear plate and an elongate inner cutter which is held in shearing contact with the inner concave surface of the foil and is reciprocated, in use by a drive motor.

These inner cutters are usually formed as carriers having a number of individual cutter blades secured thereto, so as to present a plurality of cutting teeth extending transversely of the axis of reciprocation of the cutter.

Various theoretical proposals have been made to form an inner cutter as a right cylindrical tube which is slotted transversely to form a plurality of teeth. A cutter of this form is very attractive from the manufacturing viewpoint since the critical outside diameter is easily controlled by mass production techniques, such as centreless grinding. Also the cutter is very easily cleared of shaving debris, even if the cutter is of very small diameter.

In practice, however, inner cutters of this form have never reached the marketplace and this is believed to be due to the inability of manufacturers to strike a satisfactory compromise between providing a tooth width which is large enough to ensure adequate strength of the teeth and narrow enough to prevent undue rubbing with consequential over-heating of the inner cutter and shear plate, and extra loading of the motor.

The present invention aims at the provision of an inner cutter which avoids the above stated disadvantages, and resides broadly in an inner cutter for a dry shaver, comprising a metallic tube of right-circular cross-section slotted transversely at intervals along its length to define a series of arcuate bridge members, wherein arcuate teeth of lesser axial extent than the bridge members are formed on the bridge members by cutting shallow annular grooves in the external diameter of the tube.

In this way, the strength of the individual teeth is scarcely diminished but the area of contact between the teeth and shear plate is substantially reduced.

In a preferred method of forming such an inner cutter, the annular grooves are formed in a tube of hardenable steel, which is then hardened, then slotted transversely and finally ground to its required outside diameter.

The invention is described in more detail below, by reference to some particular embodiments thereof illustrated in the accompanying drawings, in which.

Figure 1:
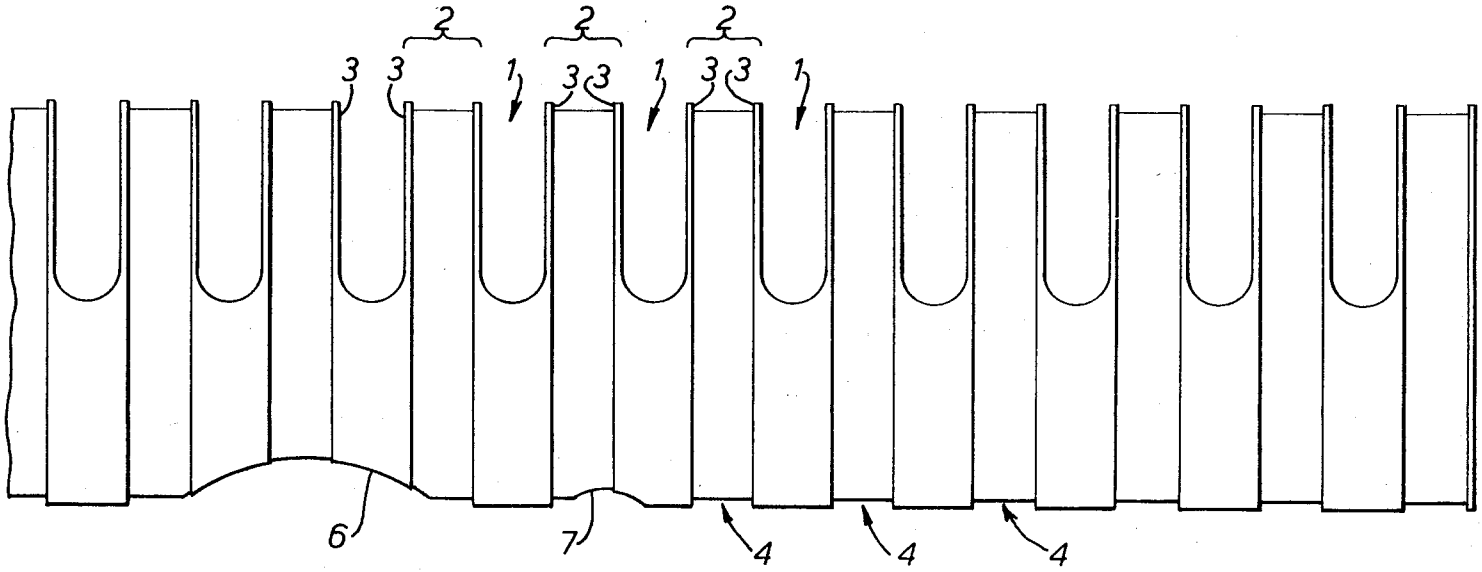
FIG. 1 is a scrap side view of one form of inner cutter.

In the embodiments described and illustrated herein, the inner cutters are each formed from hardenable steel tubes of right circular cross-section. In each case the tube is formed with a series of transverse slots 1, thus defining a series of arcuate bridge members 2 having an arcuate extent of some 180°.

Individual teeth 3 are formed on the bridge members by cutting shallow annular grooves 4 in the external diameter of the tube, so that the teeth are of lesser axial extent than the bridge members.

In a preferred manufacturing sequence, the grooves 4 are formed in the tube, by grinding or turning, the tubes are then hardened, then slotted transversely and finally the outside diameter is finished by centerless grinding.

To facilitate attachment to a mounting member (not shown) the tube is drilled through at its mid-length from below to form a large hole 6 and two smaller holes 7 to either side.

Figure 2:
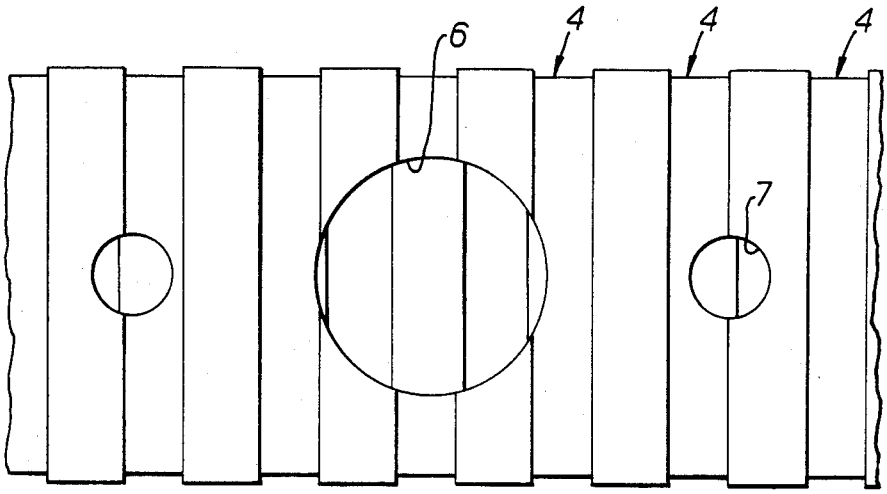
FIG. 2 is a scrap bottom plan view of the cutter of FIG. 1.
Figure 3:
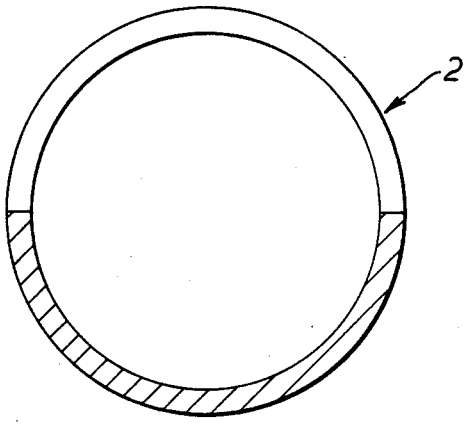
FIG. 3 is a typical section of the cutter of FIG. 1.
Figure 4:
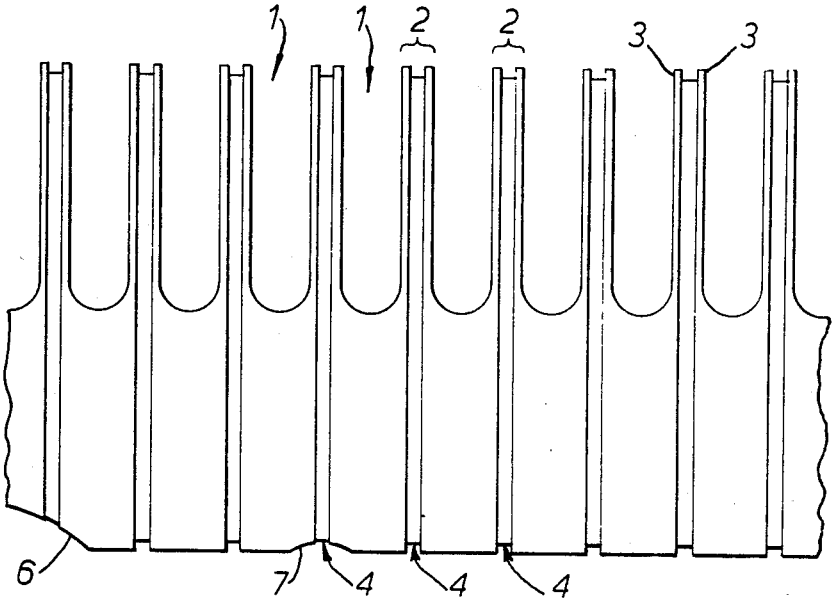
FIG. 4 is a scrap side view of a second form of inner cutter.

In the inner cutters shown in FIGS. 1 to 3, and in FIG. 4, each groove 4 is in registry with a corresponding bridge member 2 and of lesser width, so as to define a pair of individual teeth 3, one at each axial margin of the bridge member.

The cutters of FIGS. 1 and 4 vary only in their proportions. In each case, the cutter may be some 47 mm long with an outside diameter of 7.6 mm, a groove depth of 0.25 mm, and the individual teeth 3 have a width of 0.1 mm.

In FIG. 1, the width of the bridge members is 1.43 mm, while in FIG. 4 it is only 0.3 mm.

Figure 5:
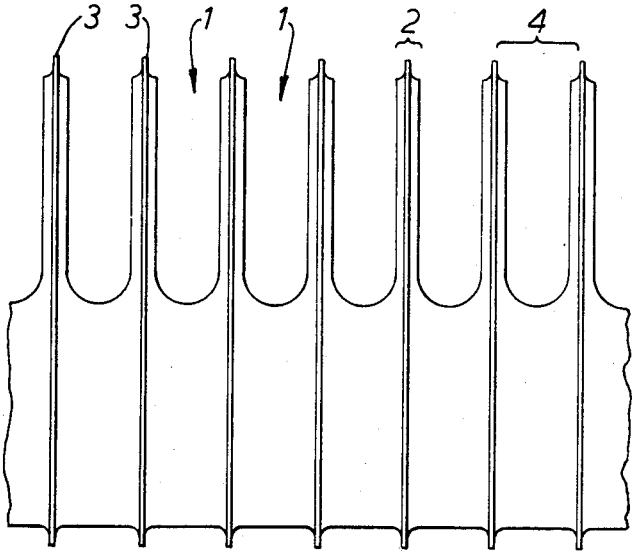
FIG. 5 is a scrap side view of a third form of inner cutter.

Because of the radial assymmetry of the full diameter portions of the above described inner cutters, some eccentricity can arise during centreless grinding. This may be tolerable for many applications but in the presently preferred form of cutter illustrated in FIGS. 5 and 6, this assymmetry is obviated.

In this embodiment, each annular groove 4 spans a respective slot 1 and an axial margin of the bridge member 2 to either side, so that each bridge member has but a single tooth 3 formed on it. Each tooth forms part of an annular band of uniform width extending completely around the tube between adjacent grooves.

Figure 6:
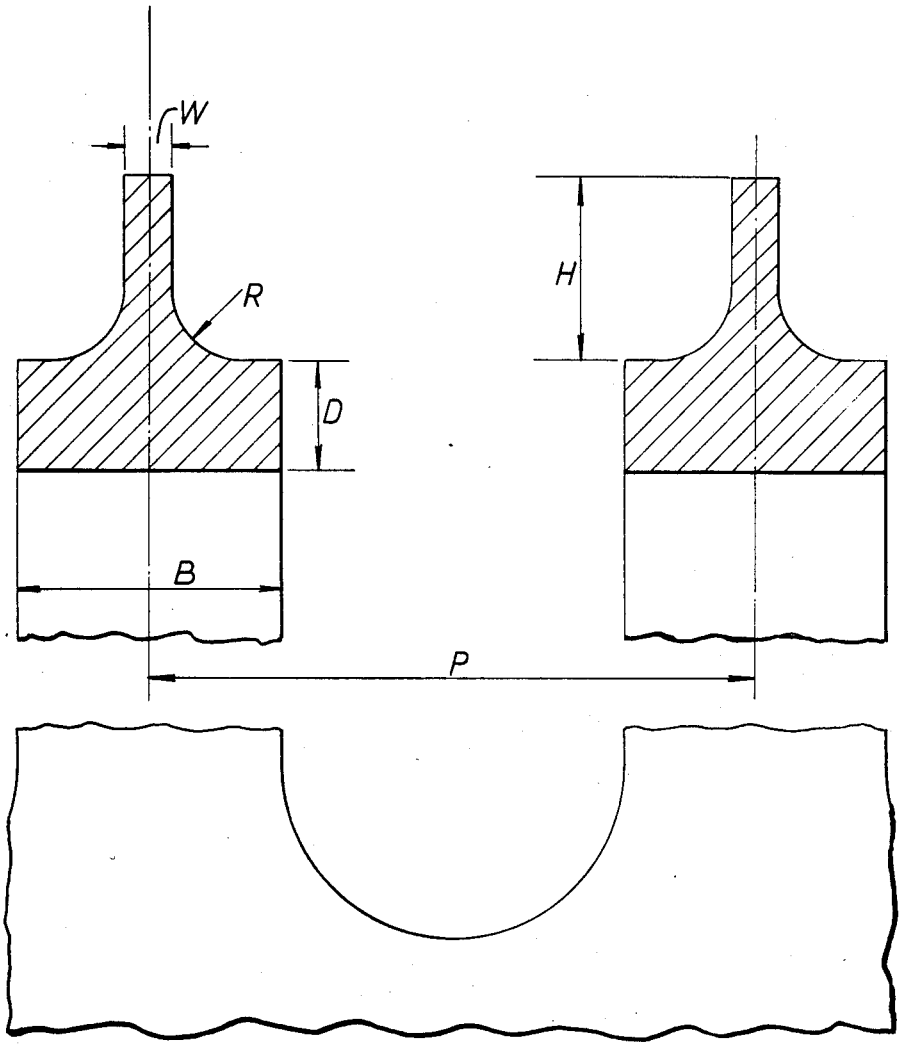
FIG. 6 is a partial, axial section of the cutter of FIG. 5.

FIG. 6 shows in greatly enlarged detail the form of the individual bridge members and teeth after final external grinding.

For an inner cutter of 7.6 mm outside diameter: the pitch P of the bridge members and teeth is 1.33 mm; the width W of each tooth is 0.1 mm; the width B of each bridge member is 0.6 mm (giving a slot width of 0.73 mm); the height of each tooth H is 0.37 mm; and the residual depth D of each bridge member is 0.25 mm.

For improved stress distribution radii R are formed at the base of the tooth, the radius R being approximately 0.15 mm.

These dimensions can of course be varied, but as a general guide we prefer to maintain the tooth height H between 0.25 and 0.40 mm, although useful performance can be obtained with a tooth height H of between 0.15 mm and 0.70 mm.

This form of inner cutter is particularly advantageous from the point of view of the final grinding operation, since only the narrow annular bands are subjected to grinding, which both reduces total ground area and avoids the imposition of any eccentric loads arising in the operation. Also, the transverse slotting operation is non-critical with regard to precise positioning of the slots, which play no part in defining tooth width. The cutter is also particularly well equipped to permit easy clearance of debris from the sides of the teeth, by virtue of the radii at the base of the teeth.

I claim:

1. An inner cutter for a dry shaver, comprising an annular metallic hollow tube having a 360° right-circular cross-section, a plurality of slots formed transversely at intervals along the length of said tube to provide fluid communication between the exterior of said tube and the hollow interior of said tube to define a series of arcuate bridge members, a plurality of arcuate teeth of lesser axial extent than said bridge members formed on said bridge members by shallow annular grooves formed at finite depth in the external circumference of said tube, said grooves reducing the thickness of said bridge members, each of said bridge members having a single tooth formed thereon, the thickness of said bridge members to either side of said tooth being reduced by the depth of said grooves, wherein each of said grooves span a respective slot and an axial margin of the adjacent said bridge member on each side of the said slot, so that each of said arcuate teeth form part of an annular band extending commpletely around said tube between adjacent said grooves.

2. An inner cutter according to claim 1, wherein the depth of said grooves, and thus the radial height of said arcuate teeth, is between 0.25 and 0.40 mm.

3. An inner cutter according to claim 2, wherein the axial width of each said bridge member is 0.6 mm and the width of each said tooth is 0.1 mm.

4. In or for use in a dry shaver comprising an arched, perforated foil shear plate, an inner cutter for shearing co-operation with said shear plate, said inner cutter comprising an annular metallic hollow tube having a 360° circular cross-section, a plurality of slots formed transversely at intervals along the length of said tube to provide fluid communication between the exterior of said tube and the hollow interior of said tube and to define a series of arcuate bridge members separated by said slots, and means defining a plurality of shallow annular grooves formed at a finate depth in the external circumference of said tube, said grooves reducing the thickness of said bridge members, each of said grooves aligned with one of said slots but of greater axial extent than said slot, said grooves defining narrow teeth, one on each of said bridge members, each tooth being of lesser axial extent than said bridge members on which it is formed, and each said tooth forming part of a continuous annular rib extending completely around said tube.

5. An inner cutter as claimed in claim 4 wherein a radius is formed at the transitions between opposite sides of said teeth and the adjacent cylindrical surfaces of said bridge members.

6. A process of forming an inner cutter for a dry shaver comprising the steps of providing an annular metallic hollow tube having a 360° right-circular cross-section;

forming a plurality of slots transversely at intervals along the length of said tube to provide fluid communication between the exterior of said tube and the hollow interior of said tube thereby forming a series of arcuate bridge members; and providing shallow annular grooves completely around said tube and formed at a finite depth in the external circumference of said tube, said tube reducing the thickness of said bridge member, thereby forming a plurality of arcuate teeth of lesser axial extent than said bridge members thereby forming said arcuate teeth as an annular band extending completely around said tube between adjacent grooves.

* * * * *